US005931236A

United States Patent [19]

Mahlum et al.

[11] Patent Number: 5,931,236

[45] Date of Patent: Aug. 3, 1999

[54] SOIL SAMPLE TAKER

[75] Inventors: Virgil Mahlum, Lake Park; Dennis Wamre, Hawley; Gordy Walker, Pelican Rapids; Tom Roy, Hawley, all of Minn.

[73] Assignee: CEE, L.L.C., Hawley, Minn.

[21] Appl. No.: 08/907,566

[22] Filed: Aug. 8, 1997

[51] Int. Cl.[6] ..... E21B 49/02

[52] U.S. Cl. ..... 175/20; 73/864.45

[58] Field of Search ..... 175/20; 73/864.44, 73/865.45

[56] References Cited

U.S. PATENT DOCUMENTS

| | | | |
|---|---|---|---|
| 4,685,339 | 8/1987 | Philipenko | 73/864.45 |
| 5,211,248 | 5/1993 | Nosewicz et al. | 73/864.45 X |
| 5,419,211 | 5/1995 | Rodel | 73/864.45 |
| 5,435,176 | 7/1995 | Manchak, III | 73/864.45 X |
| 5,741,983 | 4/1998 | Skotnikov et al. | 73/864.45 |
| 5,777,242 | 7/1998 | Zaidberg et al. | 73/864.45 |

*Primary Examiner*—Thomas P. Noland

[57] ABSTRACT

A soil sample taker includes a sample-taking probe, a support frame, a removable sample-collecting receptacle having an open side and partitions hingedly disposed inside the receptacle and capable of pivoting to define essentially equally-sized compartments and to substantially close two of the compartments. An actuator having a motor, a tubular housing, a screw mechanism, an shaft, and a partition mover is used to pivot the partitions for the purpose of separating and collecting the soil samples. A control unit switch is used to energize the motor which actuates the screw mechanism which moves the shaft which moves the partition mover which moves the partitions. An air evacuator is mounted to the support frame and includes an elongate nozzle support, a nozzle housing, and a air nozzle for effectively and conveniently blowing out the bottom end of the probe where a small amount of soil sample may be engaged. This soil sample taker increases production by saving time and effectively maintains the integrity of the soil sample taken and separated.

11 Claims, 5 Drawing Sheets

SOIL SAMPLE TAKER

BACKGROUND OF THE INVENTION

This invention relates to a soil sample taker which is used to penetrate the ground a selected distance and to retrieve a soil sample and to separate the soil sample in distinctive sections and to effectively evacuate any soil sample not separated.

The prior art discloses a soil sample taker which when a selected amount of soil is taken from the ground, the user removes the soil sample taker and manually urges a selected amount of the soil out of the soil sampler and places it in a container or bucket. The user may slide a portion of the soil sample out the end of the soil sample taker and cut it off by hand and place that portion of the soil in one container and then slide another portion out the end of the soil sample taker and cut that off and place it in another container and so on until the selected soil samples are disposed and separated. The nutrients in the soil may vary according to the depths in the ground. For example, an upper layer of soil may contain different nutrients than a middle or lower layer and the middle layer may be different than either the upper or lower layer and so forth. It has become extremely important to separate the layers of the soil in order to get accurate readings of chemicals, nutrients, etc. which may be in the ground for various reasons. For example, it would be important for a new home developer to first know whether or not certain toxic chemicals exist in the ground where the new homes are to be build and to second know at what depths in the ground are the toxic chemicals located. Toxic chemicals located near the surface of the ground may pose more danger to people than toxic chemicals located much deeper in the ground. A conventional soil sample taker does not separate the soil sample into distinctive sections; wherein each section represents soil taken from a different depth in the ground. Further, if the user were not careful in separating the soil sample, some of the soil from one layer or level may contaminate the soil from another layer or level and the user may not get an accurate reading. Further, if care is not used in separating the soil sample into distinct sections, the soil sample may not be useful to the tester who cares about the what may be in the ground at various depths.

One known prior art is a SOIL SAMPLE TAKER AND VEHICLE MOUNTING ARRANGEMENT, U.S. Pat. No. 4,685,339, invented by Harry M. Philipenko, and which includes a sample-taking probe of the type described in the present invention including the support frame, and the mounting means for the sample-collecting receptacle. What it doesn't describe includes the capability of separating the soil into separate compartments in the receptacle and the capability of blowing out any soil sample in the probe not separated and collected.

SUMMARY OF THE INVENTION

The present invention relates to a soil sample taker which comprises a support frame capable of being mounted on a vehicle, a sample-taking probe which is secured to the lower end of a piston rod of a hydraulic cylinder and which is movably mounted to the support frame and which has an open side and a soil cutter at a bottom end thereof and which is used to penetrate into the ground to collect a soil sample, an extractor finger biasedly disposed between the side walls of the probe to effectively strip out the soil, a soil-collecting receptacle which is removably and pivotally mounted to the support frame and which has three compartments separated by partitions hingedly disposed inside the receptacle and further comprising a soil evacuation means which includes an air nozzle movably mounted inside a nozzle housing which is mounted to an elongate nozzle support, the air nozzle being movably disposed at the bottom end of the sample-taking probe for blowing out the soil engaged in the bottom end of the probe to prevent possible contamination when other samples are taken by the soil sample taker.

One objective of the present invention is to provide a soil sample taker which allows the user to easily, conveniently, and without contamination collect soil samples.

Another objective of the present invention is to provide a soil sample taker which allows the user to easily and conveniently separate the soil sample so as to maintain the integrity of the soil taken.

Also, another objective of the present invention is to provide a soil sample taker which will substantially improve production by substantially reducing the amount of time needed to take the samples.

Yet, another objective of the present invention is to provide a soil sample taker which allows the user to easily and conveniently remove or evacuate any soil engaged in the bottom end of the probe so as to eliminate possible contamination when the probe is moved and used to take soil from another location.

Further objectives and advantages of the present invention will become apparent as the description proceeds and when taken in conjunction with the accompanying drawings wherein:

DETAILED DESCRIPTION OF THE INVENTION

Figure 1:
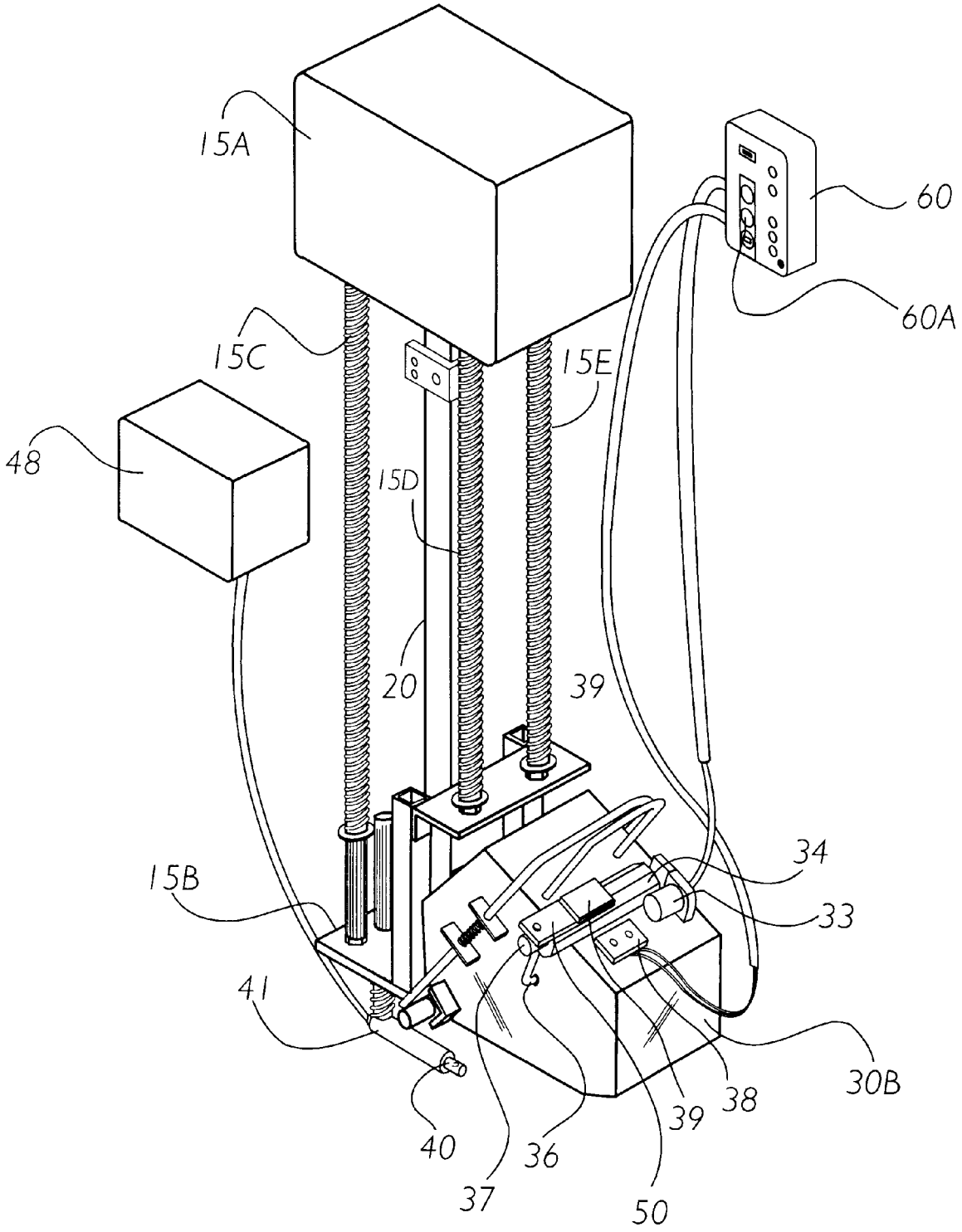
FIG. 1 is a perspective view of the soil sample taker.
Figure 2:
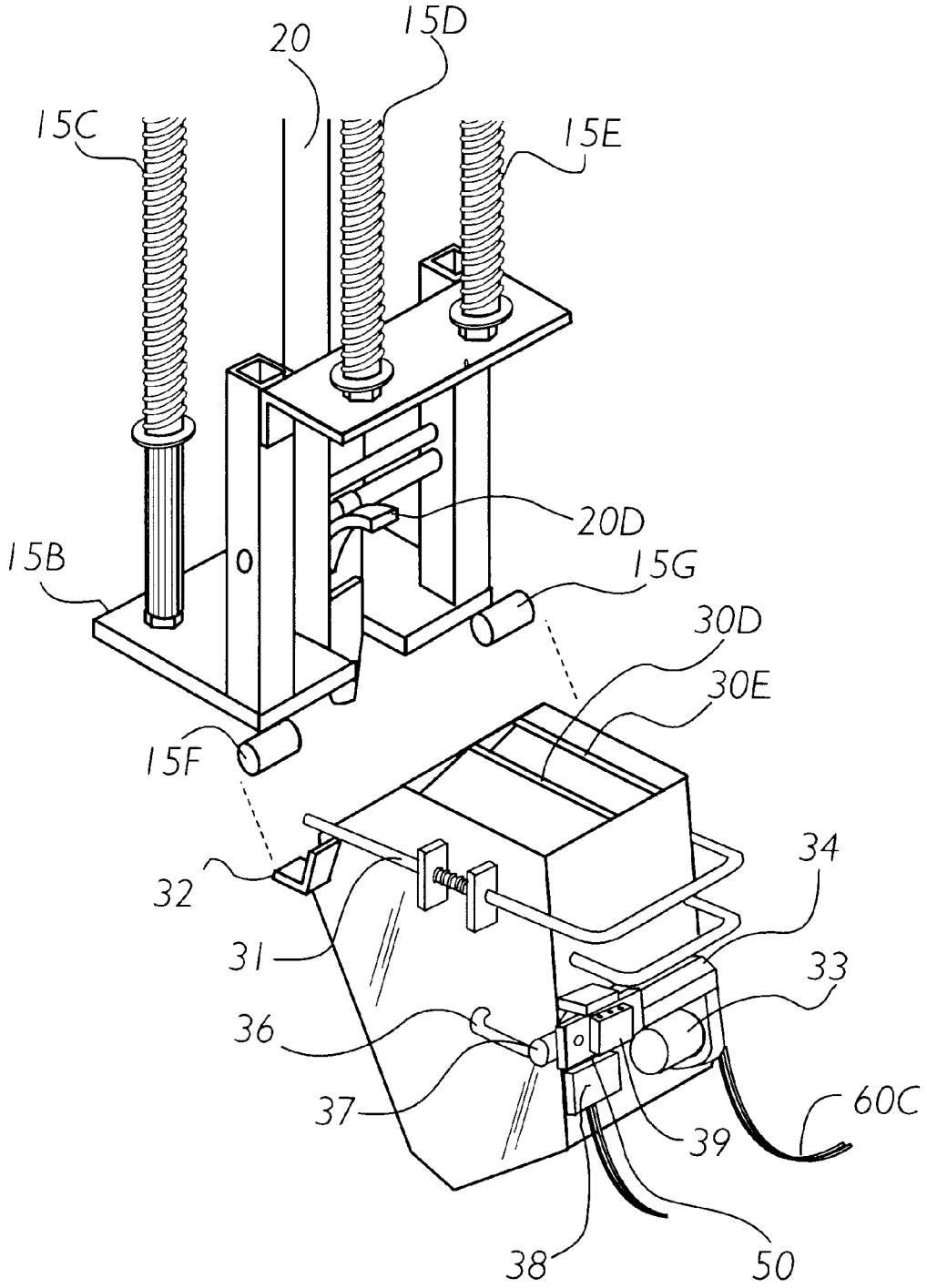
FIG. 2 is an exploded detailed view of the bottom portion of the soil sample taker.

Referring to the drawings in FIGS. 1–6, in particular, the soil sample taker comprises a support frame 15 including a movable guide assembly which includes a bottom guide support member 15B with a generally U-shaped opening through one side of the guide member support and which further includes a top guide support member 15A. Secured to the top guide support member 15A are four upwardly extending elongated guide rods 15C–E arranged to extend respectively through and slide in four bearing sleeves. An elongated compression spring is mounted on each guide rod. The upper ends of the springs seat on the bottom of the top guide support member 15A of the support frame 15, and the lower ends of the respective springs seat on spacer members mounted upon the bottom guide support member 15B. Each spring is preferably of the same length so that the force of each spring to urge the guide assembly downwardly toward the ground, is the same.

A sample collecting bucket or receptacle 30 is removably and conventionally mounted to the bottom guide support member 15B of the support frame 15. Fixedly attached to the bottom guide support member 15B are a pair of rung-like receptacle mounting members 15F–15G extending outwardly opposite to one another and generally perpendicular to the guide rods 15C–E. The receptacle 30 includes an elongate frame member 31 which is attached about the back wall 30B and the side walls 30A & 30C of the receptacle 30 and further includes a pair of mounting member supports which have slots upon which the rung-like receptacle mounting members 15F–15G can removably seat or rest. The receptacle 30 also includes a storage area which is defined by at the two side walls 30A & 30C and further includes an open side and a removable bottom wall 30G. The storage area is divided into three compartments which are separated by hinged first and second partitions which are generally the same size as the at least two side walls 30A & 30C, each of the partitions having a longitudinal vertical edge which is hingedly attached to the back wall 30B of the receptacle 30 inside thereof. The partitions are also mounted upon an elongate partition mover 36 which slidably extends through one of the side walls 30A & 30C of the receptacle 30 and further extends perpendicularly through the partitions. The first partition is conventionally mounted near one end of the elongate partition mover 36 for movement therewith and is spaced from the second partition which is also conventionally mounted upon the elongate partition mover 36 for movement therewith. The elongate partition mover 36 has another end which is connected or bolted or welded to near an end of a shaft 37 of an actuator means for movement therewith. The shaft 37 has essentially a threaded bore extending therein from one end thereof. The shaft 37 is adapted to slide in and out of a tubular housing 34 having an open end, the tubular housing 34 being fixedly mounted with conventional means to the exterior of the back wall 30B of the receptacle 30 and is generally disposed perpendicular to the side walls 30A & 30C of the receptacle 30. A screw mechanism 35 is rotatably mounted with conventional means inside the tubular housing 34 and is actuated by a motor means 33 which is also conventionally mounted to the exterior of the back wall 30B of the receptacle 30. The motor means 33 is energized by a conventional control unit switch which is connected to the motor means 33 with wires. The partitions can be swung or pivoted over to one side of the receptacle 30 with the front edges of the partitions being essentially in close proximity to the side wall through which the elongate partition mover 36 extends. Further, the partitions can be swung or pivoted to where the partitions are capable of defining or forming three generally equally sized compartments. A contact switch 38 is conventionally mounted to the exterior of the back wall 30B of the receptacle 30 as a means to indicate the positioning of the partitions inside the storage area of the receptacle 30. A contact member 39 is fixedly attached or welded to an elongate contact member support 50 which has an end fixedly mounted or bolted to near an end of the shaft 37 for movement therewith. When the partitions are swung or pivoted into essentially where the partitions define three equally-sized compartments, the contact member 39 comes into contact with the contact switch 38 which sends a signal to and lights up a light indicator on the control unit switch without the user having to visually check on the movement and arrangement of the partitions.

Figure 3:
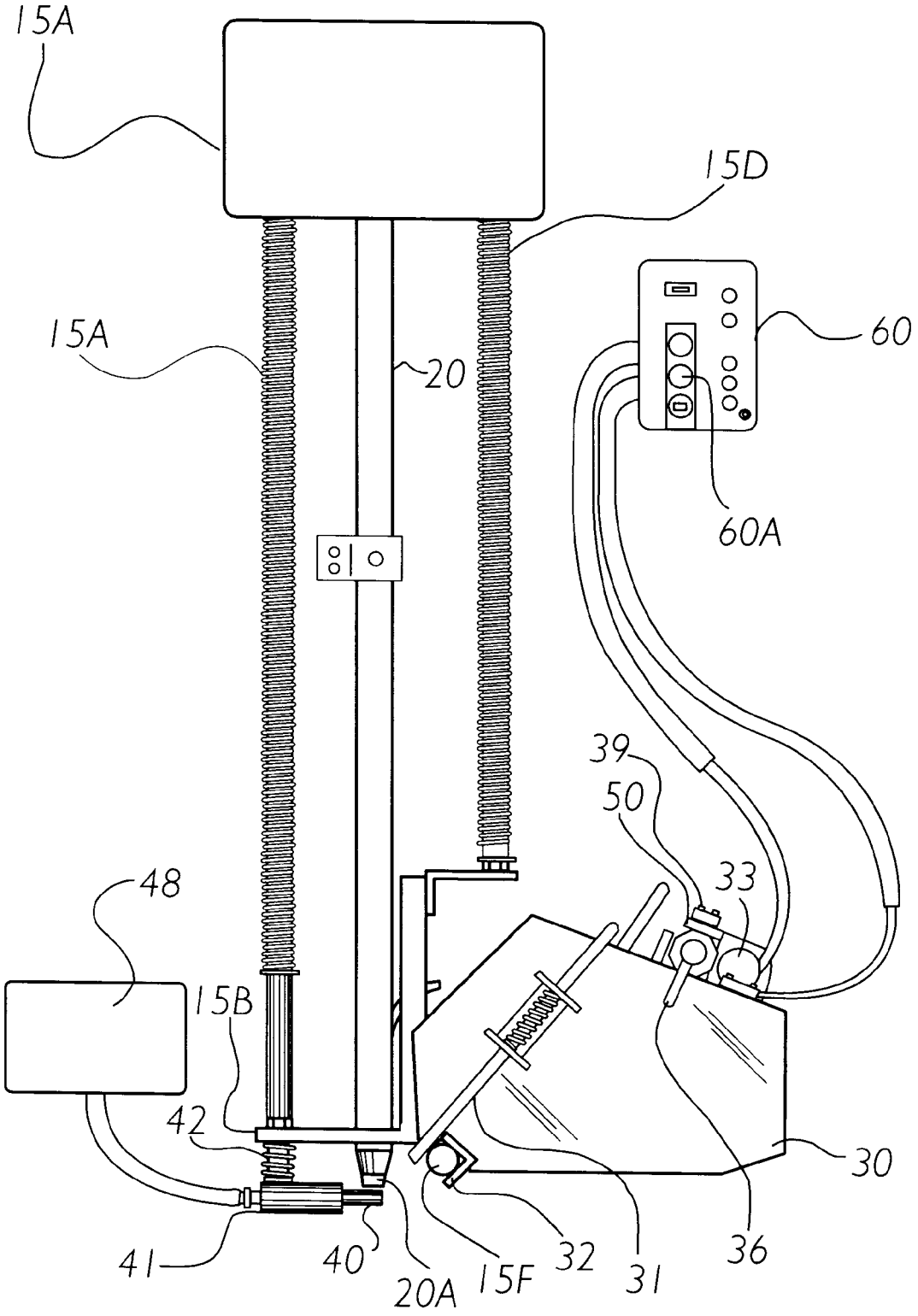
FIG. 3 is a side elevational view of the soil sample taker.
Figure 4:
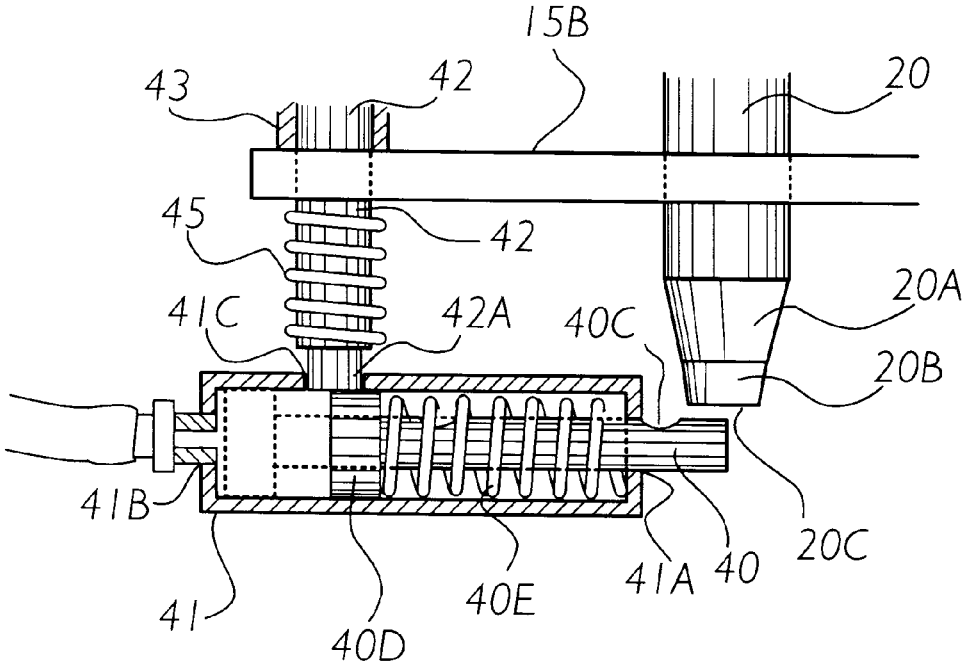
FIG. 4 is a detailed side view of the soil evacuation means for the soil sample taker.
Figure 5:
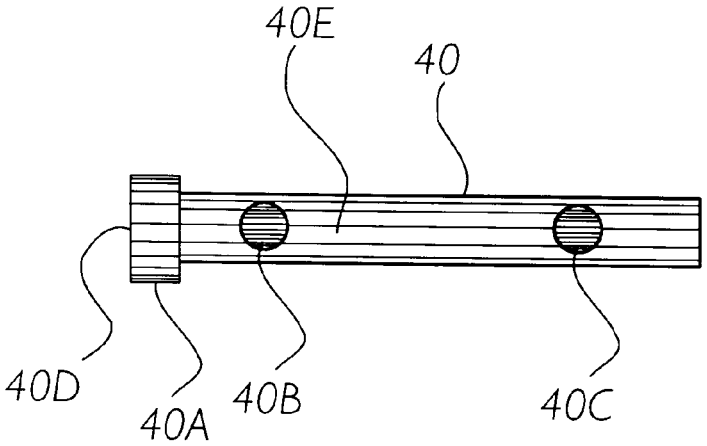
FIG. 5 is a detailed view of the air nozzle of the soil sample taker.
Figure 6:
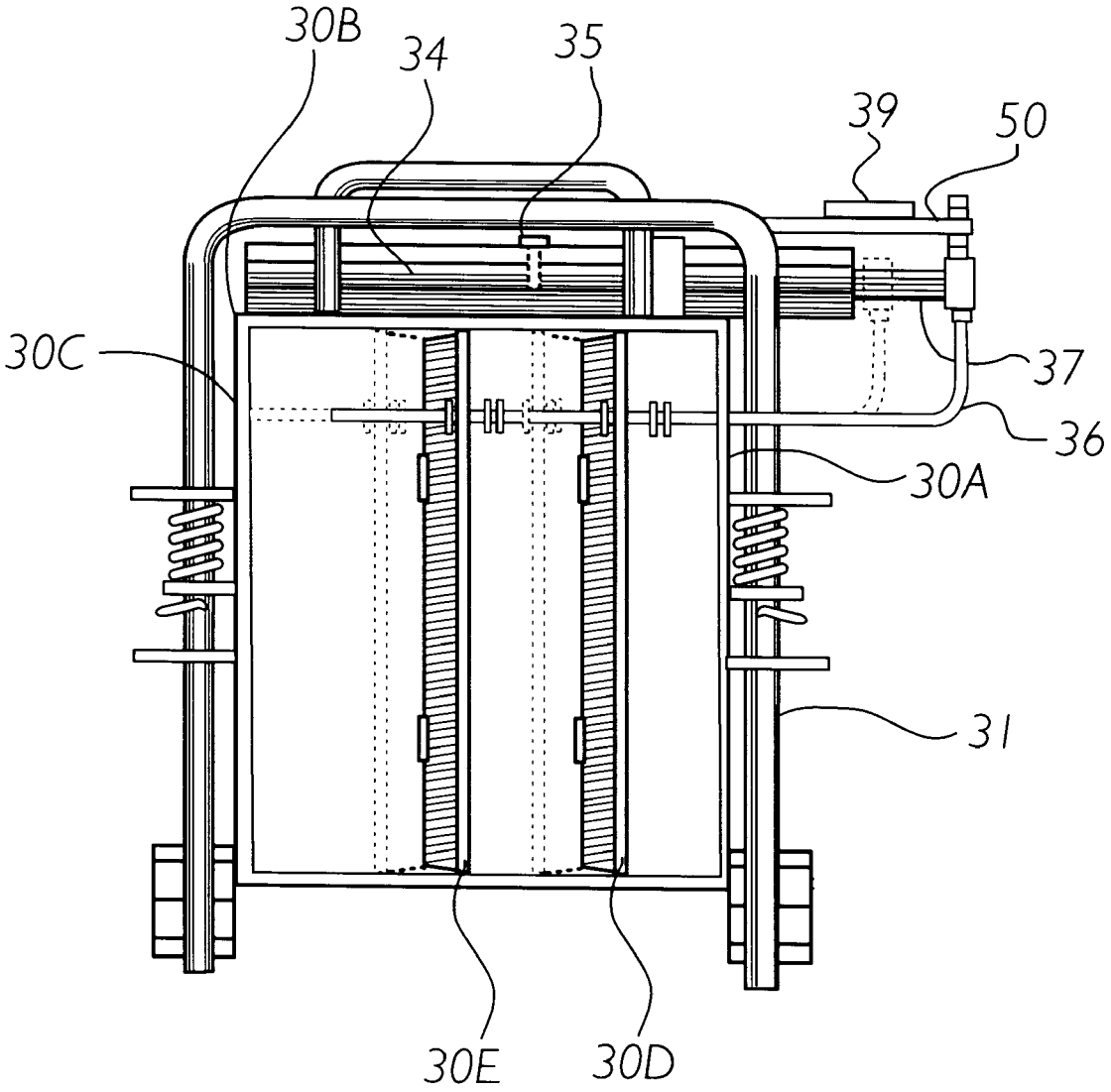
FIG. 6 is a detailed top plan view of the sample-collecting receptacle.

A sample taking probe 20 of the type described in the U.S. Pat. No. 4,685,339 is secured to a lower end of a piston rod of a hydraulic cylinder. The probe 20 is slidable in and extends though the opening in the bottom guide support member 15B and has a soil cutter 20B at its bottom end 20C with a shoulder that engages the underside of the bottom guide support member 15B to support the movable guide assembly when the probe 20 is in its retracted position as shown in FIG. 3. The probe 20 is secured to a piston rod (not shown). The probe 20 is formed from heavy gauge sheet metal shaped in a lateral cross-sectional U-shape such that the probe 20 has spaced side walls and a rear wall. The open side 20D of the probe 20 is opposite the rear wall and faces the receptacle 30 and is preferably square. An extractor finger for extracting soil from the probe 20 is pivotally connected to a bracket and is essentially an arcuately curved blade. Attached to the back of the extractor finger are spaced apart mounting sleeves. A torsion spring is positioned between these sleeves, and the extractor finger is pivotally connected to a bolt or pin which extends through bracket members, the sleeves, and the opening through the center of the torsion spring. The torsion spring functions to bias the finger such that the lower rear surface of the extractor finger is within the channel of the probe 20 and urged against the rear wall of the probe 20. The extractor finger has a width which is slightly less than the distance between the side walls of the probe 20. As a result, the extractor finger clearly strips a sample through the open side 20D of the probe 20 as the probe 20 containing a soil sample is moved upwardly through the bottom guide support member 15B. The extractor finger is good at clearing out all the soil in the probe 20 except for an amount engaged in the bottom end 20C or the cone 20A. In order to remove the soil amount located in the cone 20A, an soil extractor means is mounted to the support frame 15 and includes an air nozzle 40 biasedly retracted within a nozzle housing 41 which is fixedly attached or welded to a bottom end 20C of an elongate nozzle support member 42 which slidably extends through a guide sleeve 43 which is fixedly attached or welded to the bottom guide support member 15B of the support frame 15. A support spring 45 is mounted about the elongate nozzle support member 42 and has one end conventionally attached to the nozzle housing 41 and another end conventionally attached to the guide sleeve 43 or to the support frame 15. The support spring 45 supports the elongate nozzle support member 42 and also allows the elongate nozzle support member 42 to retract upwardly through the guide sleeve 43. The nozzle housing 41 has an air inlet 41B through a first end thereof and has a open second end 41A thereof through which the air nozzle 40 slides in and out. A spring 40E is mounted about the air nozzle 40 and is biasedly disposed between an air block member 40A which is fixedly attached to a first end 40D of the air nozzle 40 and which blocks the air flow in the nozzle housing 41. The air nozzle 40 has a first hole 40B near the air block member 40A and has a second hole 40C near the other end of the air nozzle 40 and has a bore 40E extending therein from the first hole 40B through the second hole 40C, through which air passes, the first and second holes in the air nozzle 40 being disposed essentially in the same side of the air nozzle 40. Further, the nozzle housing 41 has a hole 41C in the side thereof over which the nozzle support member 42 is fixedly attached to the nozzle housing 41. The nozzle support member 42 has a recessed portion which is in alignment with the hole 41C in the nozzle housing 41 and which allows air to pass around the air block member 40A when the air block member 40A is moved essentially in alignment with the hole 41C in the nozzle housing 41. The air block member 40A has a thickness of less than the span of the hole 41C in the nozzle housing 41. An air hose is connected to a conventional adapter which is securely connected in the air inlet in the nozzle housing 41 and also connected to an air tank containing compressed air. Air entering the nozzle housing 41 from the air tank urges against the air block member 40A and moves or slides the air nozzle 40 out of the second end of the nozzle housing 41 and moves the air block member 40A in alignment with the hole 41C in the side wall of the nozzle housing 41 which allows some of the air to pass around the air block member 40A through the hole 41C in the nozzle housing 41 and the recessed area of the elongate nozzle support member 42 and around the air block member 40A and through the first hole 40B into the bore 40E and out of the second hole 40C. When the air is turned off, the spring 40E retracts the air nozzle 40 substantially within the nozzle housing 41 with the air block member 40A being moved or slid between the hole 41C in the side wall of the nozzle housing 41 and the second end of the nozzle housing 41.

In operation, the bottom guide support member 15B is rested upon the ground and the receptacle 30 is rotated and also rested upon the ground such that the open side of the receptacle 30 faces the probe 20 which is essentially an elongate hollow element, and the probe 20 is urged into the ground with conventional means such as hydraulic means. As the probe 20 penetrates the ground, the soil is compressed to form a compressed wall spaced from the open side 20D of the probe 20. This compressed wall of soil is resistant to crumbling so that soil from this wall does not fall into the open side 20D of the probe 20, and assures that an accurate sample is taken. During such downward movement of the probe 20 relative to the guide assembly, the rear wall of the probe 20 slides along the extractor finger. When the probe 20 is driven in the ground to the desired depth, for example, 24 inches, the control unit switch is used to control the withdrawal of the probe 20. Before the probe 20 is withdrawn from the ground, the partitions in the receptacle 30 can be pivoted over to one side essentially closing off all but one of the compartments by using the control unit switch to energize the actuator means which rotates the screw mechanism 35 out of the shaft 37 causing the shaft 37 to slide out of the tubular housing 34 which, in turn, causes the elongate partition mover 36 to slide outwardly of the receptacle 30, causing the partitions to pivot to one side of the receptacle 30. The control unit switch is then used to retract a selected length of the probe 20 from the ground. During this withdrawal of the probe 20, the extractor finger extracts or deflects the sample taken into the open compartment of the receptacle 30. After the selected strip is extracted into the open compartment, the control unit switch is again turned on to energize the actuator means to pivot the first partition away from the one side of the receptacle 30 to open and expose a second compartment and to align this second compartment with the open side 20D of the probe 20. Again, the control unit switch is used to retract another selected length of the probe 20. As this another length of probe 20 is retracted, the extractor finger extracts or deflects the sample occupying the retracted length of the probe 20 into the second compartment of the receptacle 30. After the selected strip is extracted into the second compartment, the control unit switch is again turned on to energize the actuator means to further pivot the first partition farther away from the one side of the receptacle 30 and to pivot the second partition away from the one side of the receptacle 30 to open and expose a third compartment and to align this third compartment with the open side 20D of the probe 20. Again, the control unit switch is conventionally used to retract another selected length of the probe 20. As this another length of probe 20 is retracted, the extractor finger extracts or deflects the sample occupying the retracted length of the probe 20 into the third open compartment of the receptacle 30. The extractor finger is capable of extracting all the soil sample from the probe 20 except for a small amount engaged in the cone 20A or the bottom end 20C of the probe 20. The extractor finger cannot reach this small amount. Before using the soil sample taker again, it is important that the small amount of soil in the cone 20A is removed so that the sample taken at another location is not contaminated and is an actual sample.

In order to save time and facilitate the process of taking soil samples, a valve on an air tank containing compressed air is opened which allows pressurized air to enter the nozzle housing 41 and move the air nozzle 40 until the air block member 40A is in alignment with the hole 41C in the side wall of the nozzle housing 41 such that an air passage around the air block member 40A is defined, which allows the pressurized air to enter the bore 40E in the air nozzle 40 through the first hole 40B and exits the bore 40E out of the second hole 40C. A portion of the air nozzle 40 is urged out of the first end of the nozzle housing 41 and the second hole 40C in the air nozzle 40 is in alignment with the open bottom end 20C of the cone 20A. The pressurized air exiting the second hole 40C of the air nozzle 40 is directed into the open bottom end 20C of the probe 20 and blows out the small amount of sample engaged in the cone 20A. Once that is removed, the air from the air tank is turned off which results in the air nozzle 40 biasedly retracting within the nozzle housing 41 and away from beneath the cone 20A or soil cutter 20B. If the user again sets the support frame 15 of soil sample taker upon the ground, the ground would urge the nozzle housing 41 upward to allow the support frame 15 to rest upon the ground.

What is claimed is:

1. A soil sample taker comprising:

a support frame;

a sample-taking probe supported on the support frame and having an elongate hollow element with an open side and a soil cutter at a bottom end thereof;

a sample-collecting receptacle removably mounted to the support frame and having a plurality of compartments therein and an open side;

means for separation of a soil sample in the sample-collecting receptacle.

2. A soil sample taker as described in claim 1, wherein said means for separation of a soil sample includes a plurality of partitions hingedly mounted inside said storage area of said sample-collecting receptacle and separating said storage area into said plurality of compartments.

3. A soil sample taker as described in claim 2, wherein said means for separation of a soil sample further includes an actuator means, an elongate partition mover, and a control unit switch.

4. A soil sample taker as described in claim 3, wherein said actuator means is a linear actuator means.

5. A soil sample taker as described in claim 4, wherein said linear actuator means includes a motor means, a shaft, a tubular housing, and a screw mechanism rotatably disposed inside said tubular housing which is securely mounted to a back wall of said sample-collecting receptacle, said tubular housing including an open end through which said shaft slidably extends, said control unit switch being used to energize said motor means which actuates said screw mechanism which linearly moves said shaft in and out of said tubular housing.

6. A soil sample taker as described in claim 5, wherein said elongate partition mover slidably extends through a side wall of said sample-collecting receptacle and extends through said plurality of said partitions, and is securely attached to said shaft for movement therewith.

7. A soil sample taker as described in claim 6, wherein each of said plurality of partitions is hingedly attached to said back wall of said sample-collecting receptacle.

8. A soil sample taker as described in claim 7, wherein each of said plurality of partitions has a rear edge which is hingedly attached to said back wall of said sample-collecting receptacle.

9. A soil sample taker as described in claim 8, wherein said plurality of partitions are disposed inside said sample-collecting receptacle to essentially pivot from a position of being generally parallel to said side wall of said sample-collecting receptacle to a position angled relative to said side wall and being proximate to said side wall of said sample-collecting receptacle to substantially close off at least one of said compartments.

10. A soil sample taker as described in claim 9, wherein said plurality of partitions are securely mounted to and spaced along said elongate partition mover for movement therewith.

11. A soil sample taker as described in claim 10, further includes a contact switch connected to said control unit switch, a contact member support which is attached to said shaft for movement therewith, and a contact member which is fixedly attached to said contact member support, said contact member being adapted to come into contact with said contact switch which sends a signal to and lights up a light indicator on said control unit switch to indicate separation of said storage area into said compartments of essentially equal size.

* * * * *